US011338567B2

(12) United States Patent
Connors et al.

(10) Patent No.: US 11,338,567 B2
(45) Date of Patent: May 24, 2022

(54) PAPER FEED AND BIASING SYSTEM AND METHOD FOR STAPLER UNIT

(71) Applicant: Toshiba TEC Kabushiki Kaisha, Shinagawa-ku (JP)

(72) Inventors: William M. Connors, Lexington, KY (US); Brad W. Towe, Versailles, KY (US)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 234 days.

(21) Appl. No.: 16/800,408

(22) Filed: Feb. 25, 2020

(65) Prior Publication Data

US 2021/0260867 A1 Aug. 26, 2021

(51) Int. Cl.

| | |
|---|---|
| ***B65H 9/10*** | (2006.01) |
| ***B41F 13/66*** | (2006.01) |
| ***B41L 43/12*** | (2006.01) |
| ***B65H 37/04*** | (2006.01) |
| ***B65H 31/34*** | (2006.01) |
| *B31F 5/00* | (2006.01) |

(52) U.S. Cl.

CPC ..... *B41F 13/66* (2013.01); *B41L 43/12* (2013.01); *B65H 31/34* (2013.01); *B65H 37/04* (2013.01); *B31F 5/001* (2013.01); *B31F 5/003* (2013.01); *B65H 2301/363* (2013.01); *B65H 2408/114* (2013.01); *B65H 2408/1142* (2013.01)

(58) Field of Classification Search

CPC ..... B41L 43/12; B41F 13/66; B31F 5/001; B31F 5/003; B65H 37/04; B65H 2408/114; B65H 2408/1142; B65H 2301/363; B65H 31/26; B65H 31/34; B65H 9/10; B65H 9/101; G03G 2215/00827; G03G 2215/00831

USPC ..... 270/58.08, 58.12

See application file for complete search history.

(56) References Cited

U.S. PATENT DOCUMENTS

| | | | | |
|---|---|---|---|---|
| 5,012,298 | A * | 4/1991 | Johdai | G03G 15/234 399/402 |
| 7,052,005 | B2 * | 5/2006 | Yamakawa | B65H 39/10 270/37 |
| 7,753,353 | B2 * | 7/2010 | McNamara | B65H 31/00 270/37 |
| 7,866,647 | B2 * | 1/2011 | Terao | B65H 31/3018 270/58.11 |

(Continued)

*Primary Examiner* — Leslie A Nicholson, III

(74) *Attorney, Agent, or Firm* — Ulmer & Berne LLP; John X. Garred

(57) ABSTRACT

A finisher assembly of a multifunction peripheral includes a vertically oriented stapler and a paper transport motor. When the paper transport motor rotates in the forward direction, printed pages from the print engine of the multifunction peripheral are received via a paper chute and a feed assist roller urges the printed pages into a vertical paper accumulation cache basin. Rotation of the paper transport motor also opens a biasing plate allowing the pages to freely enter the cache basin. Once all of the pages of the print job are in the cache basin, the paper transport motor rotates in the reverse direction causing the biasing plate to bias the printed pages, in the cache basin, against a registration surface of the vertically oriented stapler unit. The pages of the print job are stapled together the stapled print job is moved to the paper tray for collection by a user.

11 Claims, 5 Drawing Sheets

(56) References Cited

U.S. PATENT DOCUMENTS

| | | | | |
|---|---|---|---|---|
| 7,931,259 | B2 * | 4/2011 | Taguchi | B41L 43/12 270/32 |
| 8,752,819 | B2 * | 6/2014 | Sato | B65H 31/26 270/58.17 |
| 9,044,915 | B2 * | 6/2015 | Hoshino | B31F 1/0035 |
| 10,183,831 | B1 * | 1/2019 | Yamamoto | B65H 37/04 |

* cited by examiner

PAPER FEED AND BIASING SYSTEM AND METHOD FOR STAPLER UNIT

TECHNICAL FIELD

The subject application generally relates to a paper positioning system for printer stapler units, and more specifically to a paper feed and bias mechanism for stapling vertically stacked sheets of paper in a multifunction peripheral device.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

Finisher assemblies for MFPs can include a stapler unit for stapling together a stack of printed pages associated with a print job. Prior to stapling a stack of print pages, the paper stack is positioned against a registration surface of the stapler unit to ensure that all of the pages are stapled together properly. Typically the paper stack is oriented in the paper chute or finisher paper tray in a horizontal orientation, or at some angle between horizontal and vertical, such that gravity and the weight of the printed pages bias the paper stack against the registration surface of the stapler unit.

BRIEF DESCRIPTION OF THE DRAWINGS

Various embodiments will become better understood with regard to the following description, appended claims and accompanying drawings wherein:

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

Paper placement for stapling employing horizontal or angled paper stacks provides for gravity assisted paper placement for stapling. However, horizontal or angled paper placement adds significantly to a floor footprint of an MFP finisher. In example embodiments, a multifunction printer includes a finisher assembly with a vertically positioned stapler configured to staple a vertically oriented paper stack wherein paper rests primarily on its edge as opposed to its surface. By orienting the stapler vertically, instead of horizontally or at a small angle relative to horizontal, gravity is advantageously used to both feed the paper into position to be stapled and also to align the pages together in a stack. However, because the papers of the print job are not in a horizontal orientation, as it typical with horizontal staplers, gravity cannot be used to bias the stack of papers against the registration surface of the stapler unit. The finisher assembly therefore incorporates a biasing mechanism to bias the stack of papers against the registration surface of the stapler unit prior to stapling. Also advantageously, by using a slip clutch and one-way clutch, a common paper transport motor can be utilized to both drive the feed assist rollers, which urge papers into position for stapling, and also bias the papers against the registration surface prior to stapling.

Figure 1:
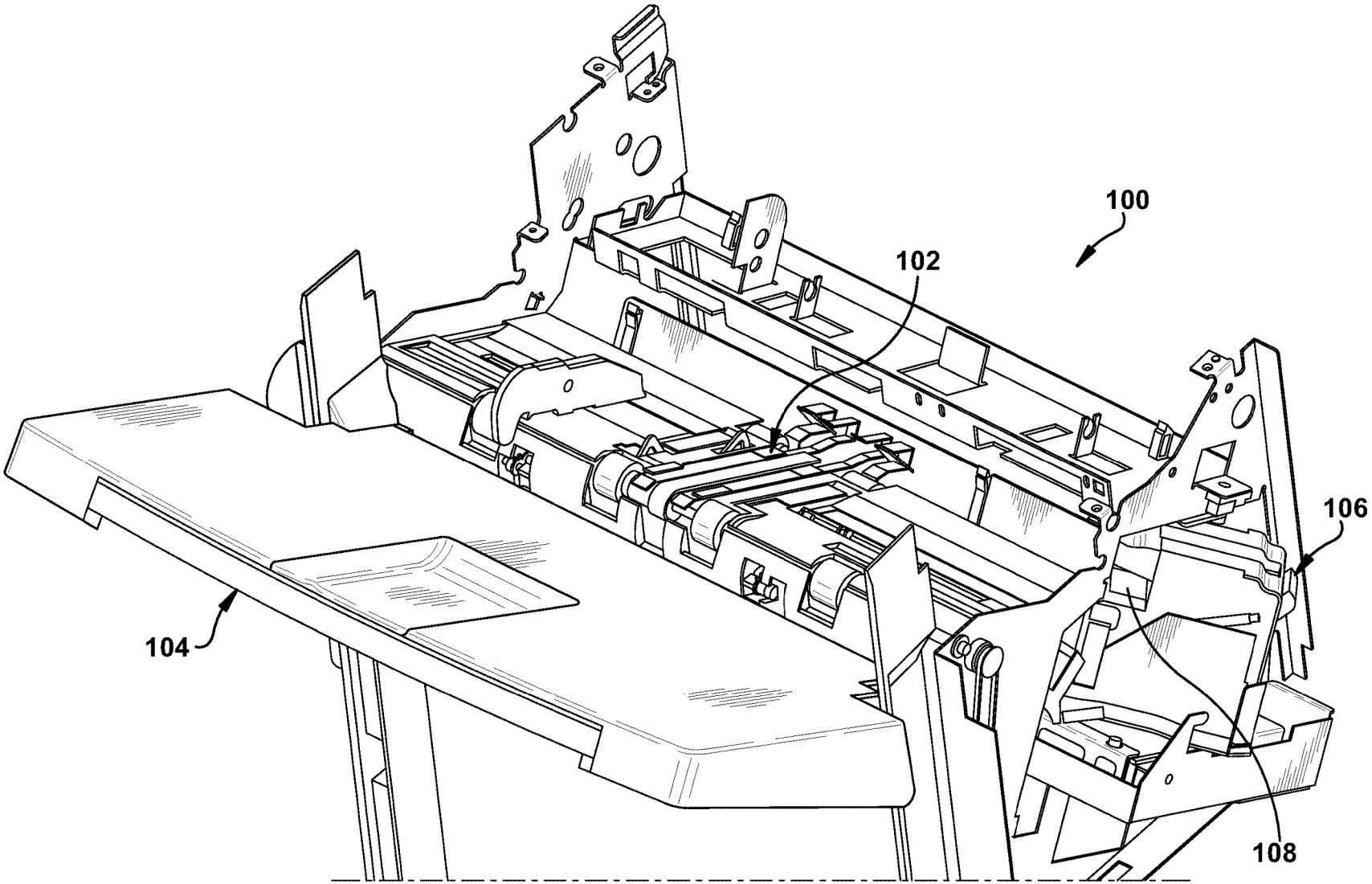
FIG. 1 is a perspective view of a finisher assembly of a multifunction peripheral that includes a horizontally disposed stapler unit.

With reference to FIG. 1, an example finisher assembly 100 of a multifunction peripheral having a horizontally oriented stapler unit 106 is presented. The finisher assembly 100 includes a finisher process tray 102, a paper tray 104 or paper accumulation tray, and the horizontally oriented stapler unit 106. The finisher process tray 102 accumulates a stack of printed pages and positions the stack against the registration surface 108 of the stapler unit 106. Because the stack of printed pages is in a horizontal or substantially horizontal orientation, gravity helps to ensure that the individual pages of the stack lay flat against one another and a registration surface of the stapler unit 106 which allows the stapler unit 106 to staple the pages together correctly. Once the stack of pages is stapled together, the finisher process tray 102 moves the stack to the paper tray 104 where a user can retrieve their stapled print job.

Figure 2:
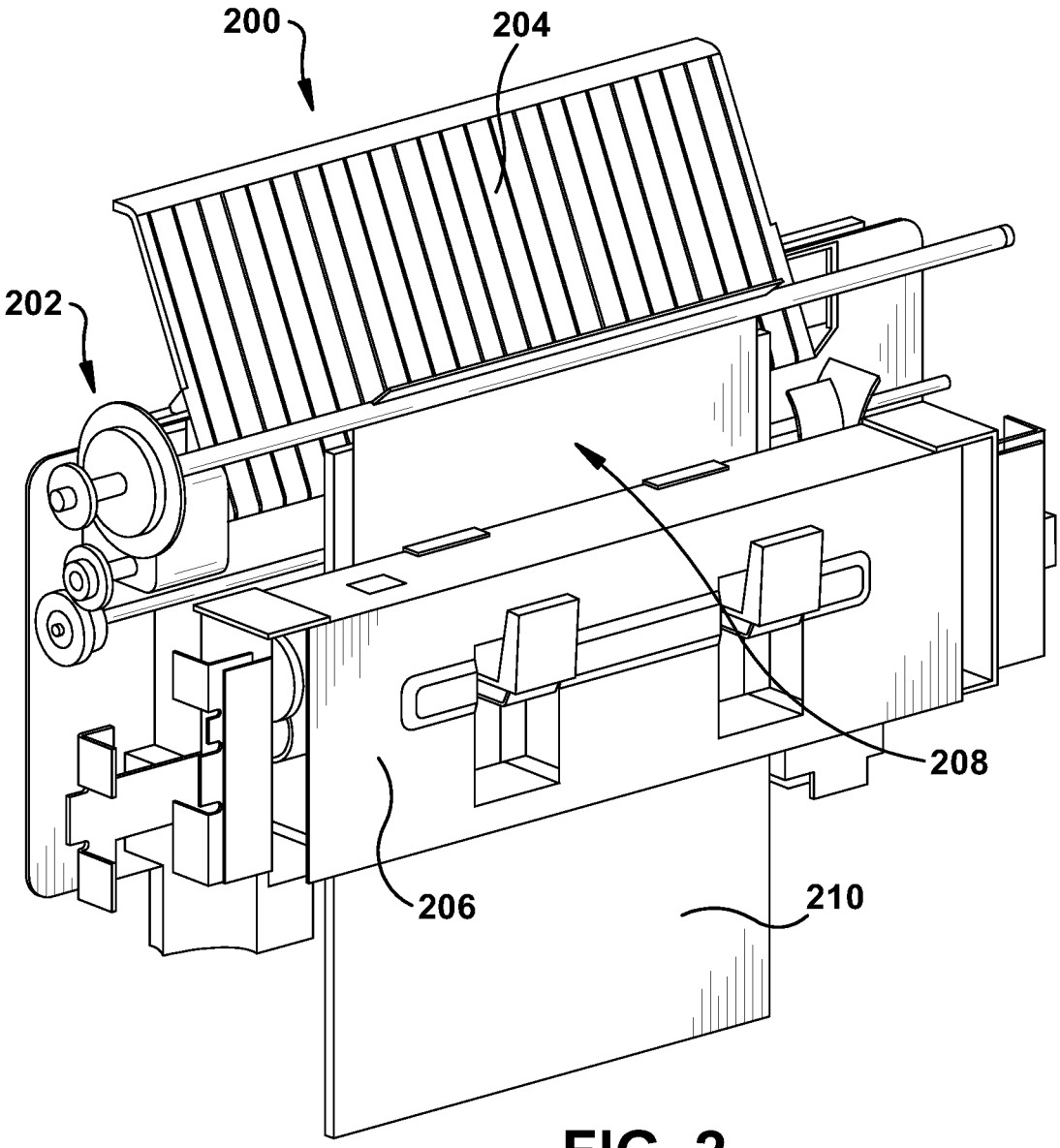
FIG. 2 is a perspective view of a finisher assembly of a multifunction peripheral that includes a vertically disposed stapler unit.

With reference to FIG. 2, a perspective view of finisher assembly 200 of a multifunction peripheral that includes a vertically positioned stapler unit 206 is presented. The finisher assembly 200 includes a paper transport mechanism 202, a vertical paper chute 204, a vertically oriented stapler unit 206, a biasing plate 208, and a paper accumulation cache basin 210. When a multifunction peripheral receives a print job that is to be stapled together, the paper transport mechanism 202 assists in urging printed pages (not shown, see registration surface 312 of FIG. 3) from the paper chute 204 into a vertically oriented paper accumulation cache basin 210 of the finisher assembly 200. Advantageously, the vertical orientation of the cache basin 210 assists in directing the printed pages down into the cache basin 210 and aligning the pages into a stack where they can be stapled by the stapler unit 206. Once all of the printed pages of the print job have been collected together in the cache basin 210, the biasing plate 208 is urged forward and biases the accumulated printed pages in the cache basin 210 against the registration surface of the vertically oriented stapler unit 206. The stapler unit 206 then staples the accumulated pages of the print job together. An example stapler unit 206 is a saddle stapler as would be understood in the art.

Figure 3:
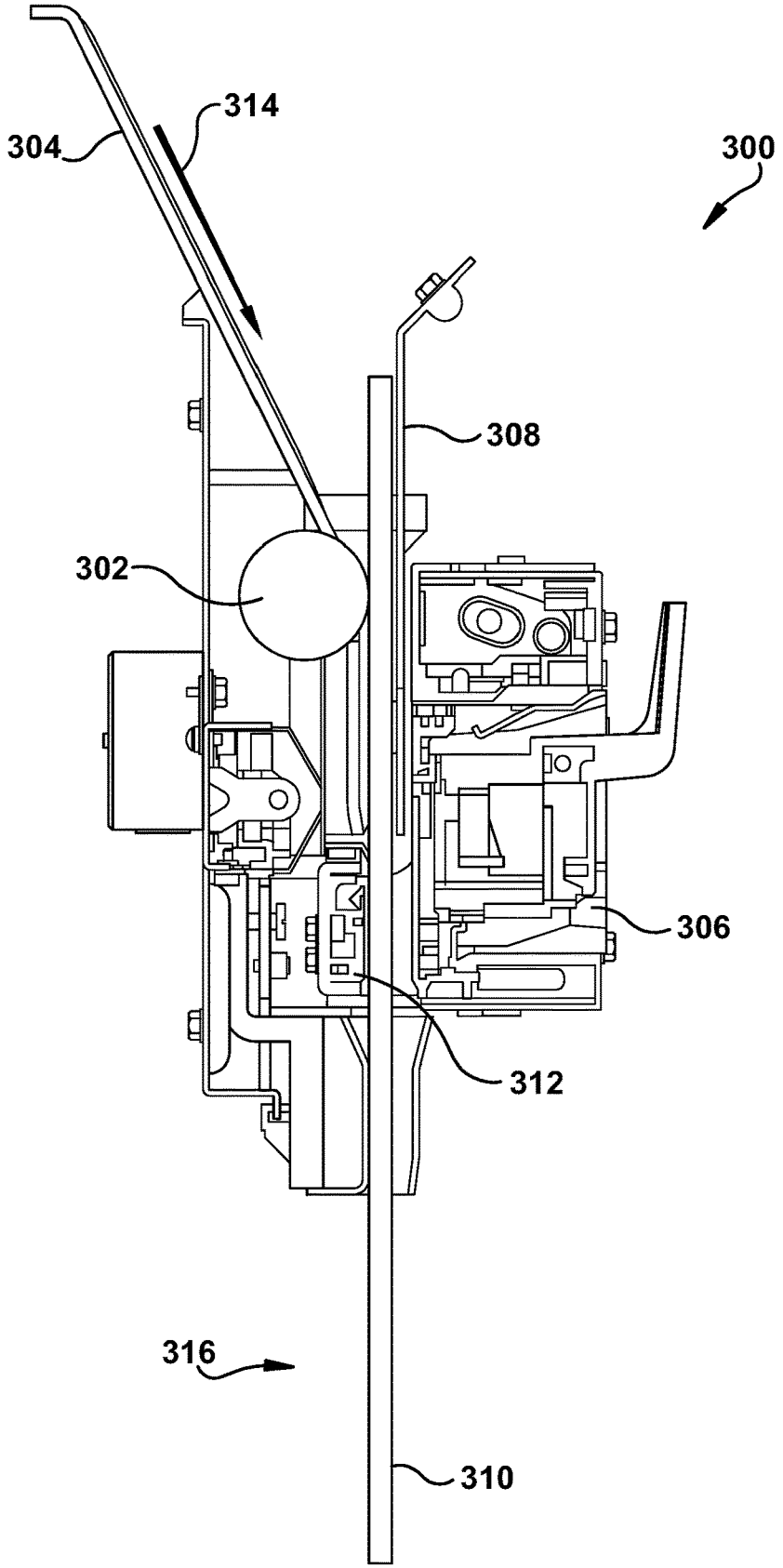
FIG. 3 is a side view of a finisher assembly of a multifunction peripheral that includes a vertically disposed stapler unit.

With reference to FIG. 3, a section side view of a finisher assembly 300 is presented. This section side view illustrates the paper path 314 for printed pages that are accumulated into a paper stack 316 in the cache basin 310 and stapled together by the vertically oriented stapler unit 306. As the pages are printed, the paper chute 304 directs the printed pages into the cache basin 310. In addition to gravity, a feed assist roller 302 urges the printed pages down into the cache basin 310 where the printed pages are collected into a paper stack 316 prior to stapling. Once all of the printed pages of a print job have been collected into the cache basin 310, the biasing plate 308 urges the paper stack 316 against the registration surface 312 of the stapler unit 306 and the paper stack 316 is stapled together. In embodiments, an alignment mechanism can intermittently actuate to keep the paper stack 316 aligned horizontally.

Figure 4A:
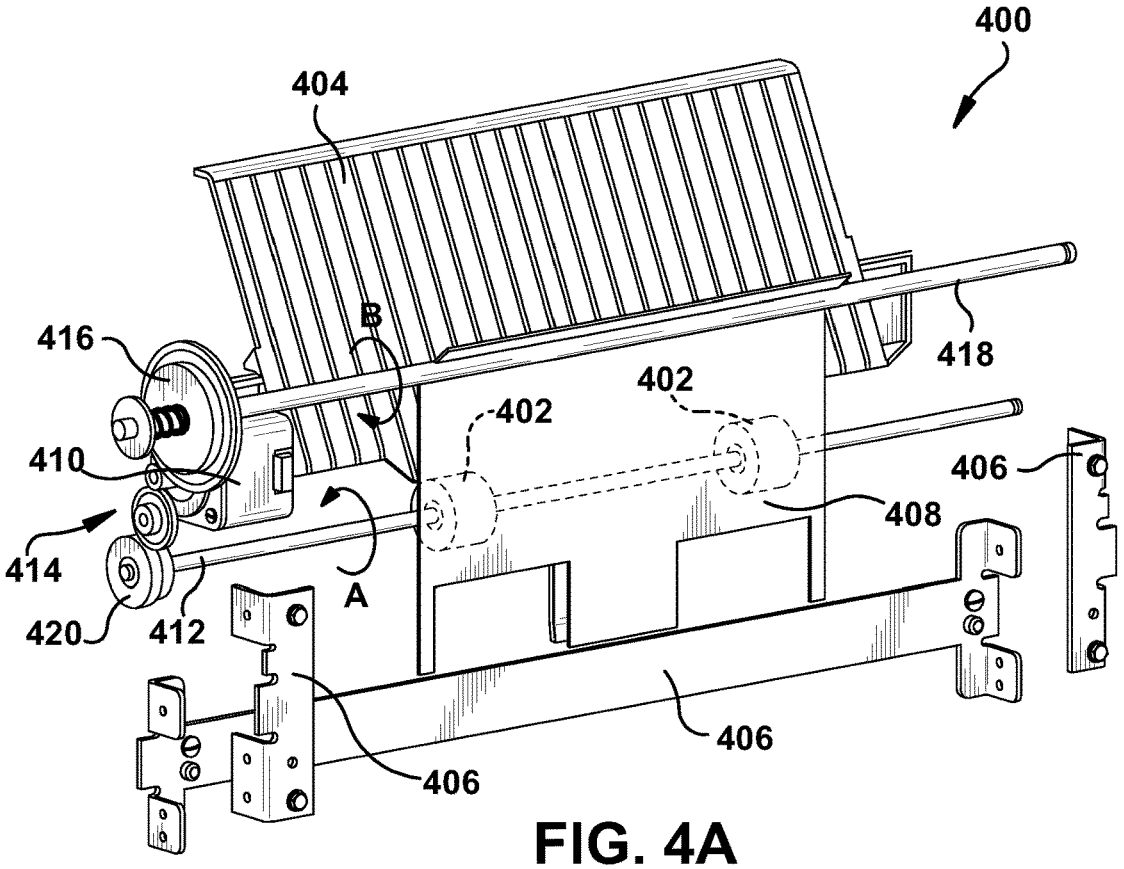
FIG. 4A is a first partial perspective view of a finisher assembly of a multifunction peripheral.
Figure 4B:
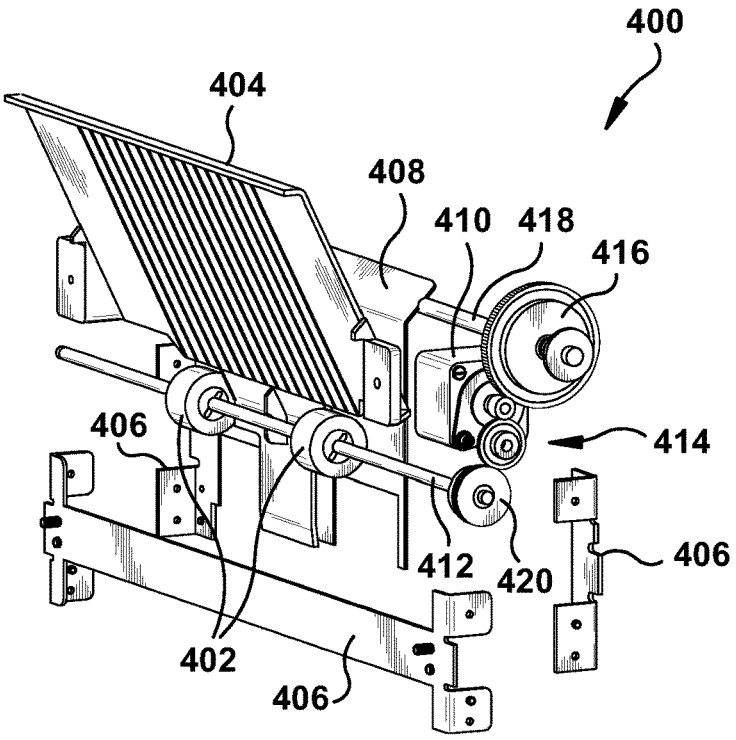
FIG. 4B is a second partial perspective view of a finisher assembly of a multifunction peripheral.

With reference to FIGS. 4A and 4B, a first partial perspective view and a second partial perspective view of an example embodiment of a finisher assembly 400 are presented. These partial views illustrate a feed assist roller 402, a feed assist shaft 412, a vertical paper chute 404, a vertically oriented stapler unit mounting bracket 406, a biasing plate 408, a biasing shaft 418, a paper transport motor 410, gearing 414, a slip clutch 416, a biasing plate shaft 418, and a one-way clutch 420. In this configuration, the paper transport motor 410 drives both the feed assist mechanism (feed assist roller 402, feed assist shaft 412, gearing 414, and one-way clutch 420) and the biasing mechanism (biasing plate 408, biasing shaft 418, and slip clutch 416.)

When the paper transport motor 410 rotates in a first direction A, for example in a clockwise direction, the one-way clutch 420 allows the feed assist shaft 412 and feed assist roller 402 to turn and feed paper present in the paper chute 404 into the cache basin (not shown, see FIG. 3 above.) At the same time, the slip clutch 416 allows the biasing shaft 418 to rotate and the biasing plate 408 is rotated open, allowing paper in the paper chute 404 to be fed into the cache basin unencumbered.

When the paper transport motor 410 rotates in a second direction B, for example in a counter-clockwise direction, the one-way clutch 420 prevents the feed assist shaft 412 and feed assist roller 402 from rotating. At the same time, the slip clutch 416 rotates the biasing shaft 418 and the biasing plate 408 is rotated closed pushing paper in the cache basin against the registration surface (not shown, see FIG. 3 above) preparing the paper stack for stapling by the vertically oriented stapler unit (not shown, see FIG. 3 above.)

In other embodiments, any suitable means of communicating rotation from the paper transport motor 410 to the feed assist roller 302 and any suitable means of communicating a biasing force to the biasing plate 308 can be used, including one or more drive shafts, belts, gears, actuators, and so forth as would be understood in the art. The term communication should be interpreted as any means for directly or indirectly transferring forces between elements, including but not limited to rotational forces such as torque being communicated between two elements through one or more intermediary elements, including but not limited to the gearing 414 as illustrated.

Figure 5:
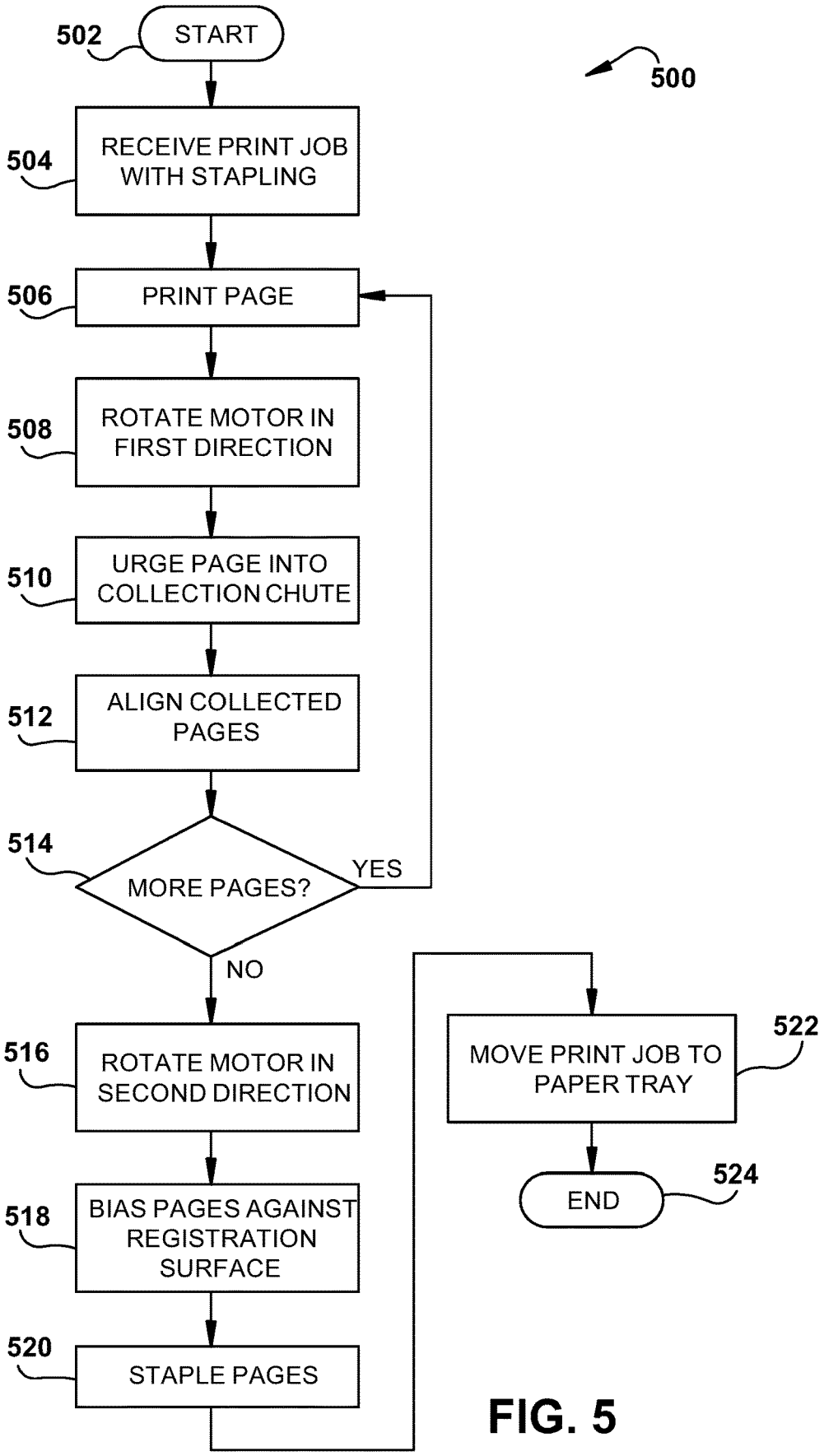
FIG. 5 is a flowchart of an embodiment of a finisher assembly of a multifunction peripheral that includes a vertically disposed stapler unit.

Referring now to FIG. 5, a flowchart 500 of example operations of a finisher assembly with a vertically oriented stapler mechanism is presented. Operation starts at block 502 and proceeds to block 504 where a print job that includes stapling is received by an MFP. Processing continues to block 506 where a print engine of the MFP prints a page of the print job. At block 508, the paper transport motor is rotated in a first direction which, at block 510, urges the printed page from the paper chute into the paper accumulation cache basin and opens the biasing plate to allow the pages to freely enter the cache basin. At block 512 pages in the paper accumulation cache basin optionally can be aligned by a suitable alignment mechanism, for example prior to stapling. A check is made at block 514 to determine if additional pages of the print job are being printed, and if so processing returns to block 506 to print the remaining pages. If not, processing continues to block 516 where the paper transport motor is rotated in the second direction which cause the biasing plate to bias the printed pages in the cache basin against the registration surface of the vertically oriented stapler unit. At block 520 the pages of the print job are stapled together by the stapler unit, and at block 522 the stapled print job is moved to the paper tray where a user can collect their stapled print job. Processing suitably ends at block 524.

In light of the foregoing, it should be appreciated that the present disclosure significantly advances the art of stapling by finisher process trays. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An apparatus, comprising:

a paper cache basin configured to receive a plurality of printed pages of a print job into a substantially vertical oriented stack of printed pages;

a stapler configured to staple the stack of printed pages of the print job;

a biasing plate configured to urge the stack of printed pages against a registration surface of the stapler prior to stapling the stack of printed pages of the print job;

a paper chute associated with the paper cache basin and configured to receive the printed pages from an associated print engine; and a feed assist roller configured to urge the printed pages received at the paper chute into the paper cache basin a motor configured to rotate the feed assist roller to urge the printed pages into the cache basin when the motor is rotated in a first direction, and further configured to bias the biasing plate against the stack of printed pages when the motor is rotated in a second direction opposite the first direction; and a slip clutch in rotational communication with the motor and the biasing plate, the slip clutch configured to bias the biasing plate against the stack of printed pages when the motor is rotated in the second direction and further configured to urge the biasing plate away from the stack of printed pages when the motor is rotated in the first direction.

2. The apparatus of claim 1, wherein the stapler is a saddle stapler.

3. The apparatus of claim 1, wherein the printed pages are urged into the paper cache basin by gravity in addition to operation of the feed assist roller.

4. The apparatus of claim 1, further comprising:

a slip clutch in rotational communication with the motor and the biasing plate, the slip clutch configured to bias the biasing plate against the stack of printed pages when the motor is rotated in the second direction and further configured to urge the biasing plate away from the stack of printed pages when the motor is rotated in the first direction.

5. The apparatus of claim 1, further comprising a one-way clutch in rotational communication with the motor and the feed assist roller, the one-way clutch configured to rotate the feed assist roller when the motor is rotated in the first direction and further configured to stop the rotation of the feed assist roller when the motor is rotated in the second direction.

6. A multifunction printer, comprising:

a print engine configured to print a plurality of pages in accordance with a print job;

a paper chute configured to receive the printed pages of the print job from the print engine;

a paper cache basin configured to receive the printed pages from the paper chute and accumulate the printed pages of the print job into a substantially vertical oriented stack of printed pages;

a saddle stapler configured to staple the stack of printed pages of the print job;

a biasing plate configured to urge the stack of printed pages against a registration surface of the saddle stapler prior to stapling the stack of printed pages of the print job;

a feed assist roller configured move the printed pages received at the paper chute into the paper cache basin;

a motor configured to rotate the feed assist roller for moving the printed pages into the cache basin when the motor is rotated in a forward direction, and further configured to bias the biasing plate against the stack of printed pages when the motor is rotated in a reverse direction; and a slip clutch in rotational communication with the motor and the biasing plate, the slip clutch configured to bias the biasing plate against the stack of printed pages when the motor is rotated in the reverse direction and further configured to urge the biasing plate away from the stack of printed pages when the motor is rotated in the forward direction.

7. The multifunction printer of claim 6, further comprising a one-way clutch in rotational communication with the motor and the feed assist roller, the one-way clutch configured to rotate the feed assist roller when the motor is rotated in the forward direction and further configured to stop the rotation of the feed assist roller when the motor is rotated in the reverse direction.

8. The multifunction printer of claim 7, further comprising a rotatable shaft associated with the feed assist roller; and gearing configured to communicate the rotation of the motor to the rotatable shaft through the one-way clutch.

9. A method, comprising:

receiving, by a print engine, a plurality of pages associated with a user print job;

printing, by the print engine, each page of the plurality of pages;

receiving, in a paper cache basin, each of the printed pages in a substantially vertical orientation;

urging the printed pages against a registration surface of a stapler;

stapling the printed pages of the user print job;

moving, by a feed assist roller, each of the printed ages received at a paper chute from the print engine into the paper chute rotating a motor in a forward direction to rotate the feed assist roller; and rotating the motor in the reverse direction to bias a biasing plate against the printed pages and urge the printed pages against the registration surface of the stapler;

wherein rotating the motor in the reverse direction stops the rotation of the feed assist roller.

10. The method of claim 9, wherein the stapling is performed by a vertically oriented saddler stapler.

11. The method of claim 9, wherein rotating the motor in the forward direction moves the biasing plate away from the printed pages in the paper cache basin.

* * * * *